US007759870B2

(12) United States Patent
Lee

(10) Patent No.: US 7,759,870 B2
(45) Date of Patent: Jul. 20, 2010

(54) PLASMA DISPLAY PANEL (PDP)

(75) Inventor: Kyu-Hang Lee, Suwon-si (KR)

(73) Assignee: Samsung SDI Co., Ltd., Yongin-Si, Gyeonggi-do (KR)

( * ) Notice: Subject to any disclaimer, the term of this patent is extended or adjusted under 35 U.S.C. 154(b) by 525 days.

(21) Appl. No.: 11/707,994

(22) Filed: Feb. 20, 2007

(65) Prior Publication Data

US 2007/0228978 A1 Oct. 4, 2007

(30) Foreign Application Priority Data

Mar. 29, 2006 (KR) ..... 10-2006-0028285

(51) Int. Cl.
*H01J 17/49* (2006.01)

(52) U.S. Cl. ..... 313/587

(58) Field of Classification Search ..... 313/582–587; 315/169.1, 169.4, 169.3, 169.74; 345/37, 345/41, 60, 71, 30; 445/24; 361/681
See application file for complete search history.

(56) References Cited

U.S. PATENT DOCUMENTS

| | | | |
|---|---|---|---|
| 5,541,618 | A | 7/1996 | Shinoda |
| 5,661,500 | A | 8/1997 | Shinoda et al. |
| 5,663,741 | A | 9/1997 | Kanazawa |
| 5,674,553 | A | 10/1997 | Shinoda et al. |
| 5,724,054 | A | 3/1998 | Shinoda |
| 5,786,794 | A | 7/1998 | Kishi et al. |
| 5,952,782 | A | 9/1999 | Nanto |
| RE37,444 | E | 11/2001 | Kanazawa |
| 6,630,916 | B1 | 10/2003 | Shinoda |
| 6,707,436 | B2 | 3/2004 | Setoguchi et al. |

(Continued)

FOREIGN PATENT DOCUMENTS

JP 02-148645 6/1990

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Joseph L Williams
*Assistant Examiner*—Brenitra M Lee
(74) *Attorney, Agent, or Firm*—Robert E. Bushnell, Esq.

(57) ABSTRACT

A Plasma Display Panel (PDP) includes: first and second substrates facing each other and spaced apart from each other; barrier ribs arranged between the first and second substrates and defining discharge cells; an address electrode extending in a first direction to correspond to the discharge cells; first and second electrodes arranged on one of the first and second substrates and extending in a second direction crossing the first direction to correspond to the discharge cells; a dielectric layer covering the first and second electrodes; a first colored layer arranged on a portion of the barrier ribs close to the first and second electrodes, and a second colored layer arranged on the dielectric layer and corresponding to the first colored layer, the first and second colored layers inducing a subtractive color effect.

12 Claims, 3 Drawing Sheets

U.S. PATENT DOCUMENTS

| | | | | |
|---|---|---|---|---|
| 2005/0035713 | A1* | 2/2005 | Yoo | 313/582 |
| 2005/0040767 | A1* | 2/2005 | Yoo et al. | 313/587 |
| 2006/0175971 | A1* | 8/2006 | Yoo et al. | 313/586 |
| 2006/0226778 | A1* | 10/2006 | Choo | 313/582 |
| 2007/0103073 | A1* | 5/2007 | Jeong | 313/582 |

FOREIGN PATENT DOCUMENTS

| | | |
|---|---|---|
| JP | 2845183 | 10/1998 |
| JP | 2917279 | 4/1999 |
| JP | 2001-043804 | 2/2001 |
| JP | 2001-325888 | 11/2001 |

* cited by examiner

PLASMA DISPLAY PANEL (PDP)

CLAIM OF PRIORITY

This application makes reference to, incorporates the same herein, and claims all benefits accruing under 35 U.S.C. §119 from an application for PLASMA DISPLAY PANEL earlier filed in the Korean Intellectual Property Office on the 29 day of Mar. 2006 and there duly assigned Serial No. 10-2006-0028285.

BACKGROUND OF THE INVENTION

1. Field of the Invention

The present invention relates to a Plasma Display Panel (PDP), and more particularly, the present invention relates to a PDP that can improve a bright room contrast by increasing a black region ratio using a subtractive color effect while maintaining a high luminance and light emission efficiency.

2. Description of the Related Art

A Plasma Display Panel (PDP) is a display device that can display an image using red, green, and blue visible light created by exciting phosphors using Vacuum UltraViolet (VUV) rays emitted from a plasma created by a gas discharge.

For example, in an Alternating Current (AC) PDP, address electrodes are formed on a rear substrate. The address electrodes are covered by a dielectric layer. Barrier ribs are arranged in a stripe pattern on the dielectric layer between the address electrodes. Red, green, and blue phosphor layers are formed on the barrier ribs and the dielectric layer. Display electrodes having sustain and scan electrodes crossing the address electrodes are formed on a front substrate facing the rear substrate. The display electrodes are covered by a dielectric layer and an MgO protective layer. Discharge cells are formed at regions where the address electrodes formed on the rear substrate cross the display electrodes formed on the front substrate. More than several millions of unit discharge cells are arranged in a matrix pattern in the PDP.

A memory property is used for driving the discharge cells of the PDP. In more detail, in order to generate the discharge between the sustain and scan electrodes constituting a pair of display electrodes, a potential difference higher than a specific voltage is required. This boundary voltage is called a firing voltage (Vf). When scan and address voltages are respectively supplied to the scan and address electrodes, the discharge is initiated to form a plasma in the discharge cell. Electrons and ions of the plasma travel to electrodes having polarities opposite to those of the electrons and ions.

A dielectric layer is deposited on each electrode of the PDP so that most of space charges are accumulated on the dielectric layer having an opposite polarity. As a result, since the net space potential between the scan and address electrodes is lower than an initially supplied address voltage (Va), the address discharge is weakened and disappears. A relatively small amount of electrons is accumulated on the sustain electrodes and a relatively large amount of electrons is accumulated on the scan electrodes. The charges accumulated on the dielectric layer covering the sustain and scan electrodes are called wall charges (Qw). A space voltage generated between the sustain and scan electrodes by the wall charges is called a wall voltage (Vw).

When a discharge sustain voltage (Vs) is supplied to the sustain and scan electrodes and a sum (Vs+Vw) of the discharge sustain voltage (Vs) and the wall voltage (Vw) is higher than the firing voltage (Vf), a sustain discharge occurs in the discharge cells, thereby generating vacuum ultraviolet rays. The vacuum ultraviolet rays excite the corresponding phosphor layer to emit visible light through the transparent front panel.

However, when there is no address discharge between the scan and address electrodes (i.e., when no address voltage (Va) is supplied), the wall charges are not accumulated between the sustain and scan electrodes. Consequently, no wall voltage exists between the sustain and scan electrodes. At this point, only the discharge sustain voltage (Vs) supplied to the sustain and scan electrodes is formed in the discharge cells. Since the discharge sustain voltage is lower than the firing voltage (Vf), the gas space defined between the sustain and scan electrodes cannot be discharged.

For the PDP driven as described above, there has been a variety of efforts for enhancing the bright room contrast by increasing a black region ratio, i.e., a ratio of an area taken by black with respect to an entire area.

For example, a method using a subtractive color effect has been developed. However, in order to use this subtractive color effect method, a colored layer is provided in front of the phosphor layer, i.e., the discharge cell, emitting the visible light.

The colored layer provided in front of the discharge cell increases the black region ratio in the PDP or a dark area, and thus the bright room contrast is enhanced. However, the colored layer intercepts the visible light to deteriorate the luminance and light emission efficiency of the PDP.

SUMMARY OF THE INVENTION

The present invention provides a Plasma Display Panel (PDP) that can improve a bright room contrast by increasing a black region ratio using a subtractive color effect without deteriorating luminance and light emission efficiency.

According to an embodiment of the present invention, a PDP includes: first and second substrates facing each other and spaced apart from each other; barrier ribs arranged between the first and second substrates and defining discharge cells; an address electrode extending in a first direction to correspond to the discharge cells; first and second electrodes arranged on one of the first and second substrates and extending in a second direction crossing the first direction to correspond to the discharge cells; a dielectric layer covering the first and second electrodes; a first colored layer arranged on a portion of the barrier ribs close to the first and second electrodes; and a second colored layer arranged on the dielectric layer and corresponding to the first colored layer, the first and second colored layers inducing a subtractive color effect.

The first colored layer is preferably brown. The second colored layer is preferably blue. The first colored layer preferably has a pattern identical to that of the barrier ribs. The second colored layer preferably faces a pattern of the barrier ribs.

The barrier ribs preferably include first barrier rib members extending in the first direction and spaced apart from each other in the second direction at a distance corresponding to the discharge cells. The barrier ribs preferably include second barrier rib members extending in the second direction and spaced apart from each other in the first direction at a distance corresponding to the discharge cells.

The first colored layer preferably includes: first colored portions arranged on the first barrier rib members in the first direction; and second colored portions arranged on the second barrier rib members in the second direction. The second colored layer preferably includes: third colored portions arranged on the dielectric layer and corresponding to the first colored portions; and fourth colored portions arranged on the dielectric layer while crossing the third colored portions and corresponding to the second colored portions.

The dielectric layer preferably includes: a first dielectric layer covering the first and second electrodes; and a second dielectric layer arranged on the first dielectric layer. The second dielectric layer preferably has a thickness identical to that of the second colored layer. The second dielectric layer is preferably arranged in portions divided by the third and fourth colored portions of the second colored layer.

The PDP of further preferably includes a protective layer covering the second dielectric layer and the second colored layer.

BRIEF DESCRIPTION OF THE DRAWINGS

A more complete appreciation of the present invention and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

The present invention is described more fully below with reference to the accompanying drawings, in which embodiments of the present invention are shown. The present invention may, however, be embodied in many different forms and should not be construed as being limited to the embodiments set forth herein; rather these embodiments are provided so that this disclosure will be thorough and complete, and will fully convey the concept of the present invention to those skilled in the art. Wherever possible, the same reference numbers will be used throughout the drawings to refer to the same or like parts.

Figure 1:
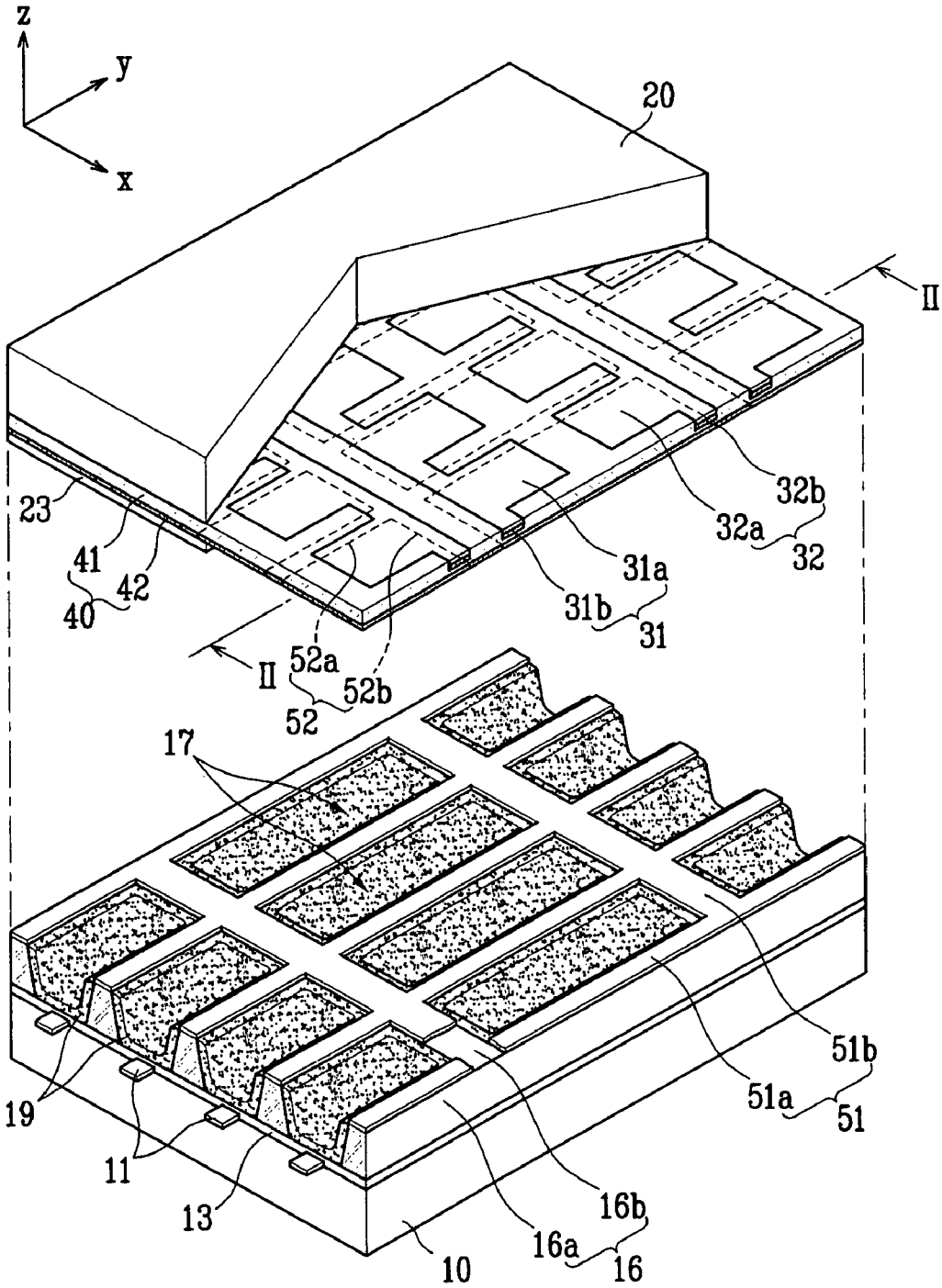
FIG. 1 is a schematic exploded perspective view of a Plasma Display Panel (PDP) according to an embodiment of the present invention.
Figure 2:
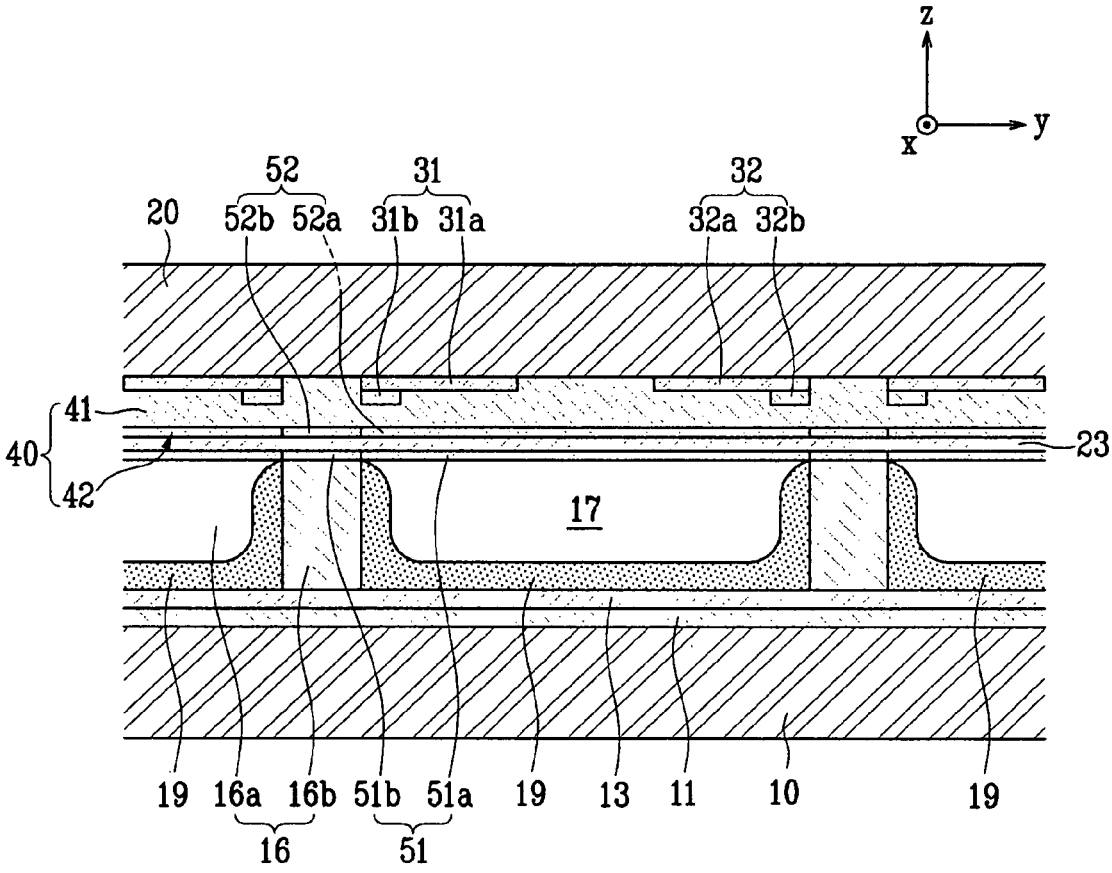
FIG. 2 is a sectional view taken along line II-II of FIG. 1.

FIG. 1 is a schematic exploded perspective view of a Plasma Display Panel (PDP) according to a first embodiment of the present invention, and FIG. 2 is a sectional view taken along line II-II of FIG. 1.

Referring to FIGS. 1 and 2, a PDP according to a first embodiment of the present invention includes first and second substrates (hereinafter respectively referred to as "rear and front substrates") 10 and 20 spaced apart from each other and facing each other and sealed together, and barrier ribs 16 disposed between the rear and front substrates 10 and 20. The barrier ribs 16 are formed between the rear and front substrates 10 and 20 to define a plurality of discharge cells 17. The discharge cells 17 are filled with a discharge gas (e.g., a mixture gas including neon (Ne) and xenon (Xe)) to create vacuum ultraviolet rays using a gas discharge. The discharge cells 17 have phosphor layers 19 for absorbing the vacuum ultraviolet rays and emitting visible light.

In order to display an image using the gas discharge, the PDP includes address electrodes 11, first electrodes (hereinafter referred to as "sustain electrodes") 31, and second electrodes (hereinafter referred to as "scan electrodes") 32. The address, sustain, and scan electrodes 11, 31 and 32 are arranged between the rear and front substrates 10 and 20 to correspond to the discharge cells 17.

For example, the address electrodes 11 extend in a first direction (the y-axis in the drawings) on an inner surface of the rear substrate 10 to continuously correspond to the discharge cells 17 that are adjacent to each other along the y-axis. In addition, the address electrodes 11 are arranged in parallel corresponding to the discharge cells 17 that are adjacent to each other in a second direction (the x-axis in the drawings) crossing the y-axis.

As described above, the address electrodes 11 are covered by a dielectric layer 13 deposited on an inner surface of the rear substrate 10. The dielectric layer 13 prevents the address electrodes 11 from being damaged by preventing positive ions or electrons from directly colliding with the address electrodes 11, and generates and accumulates wall charges. Since the address electrodes 11 are arranged on the rear substrate 10 so as not to interfere with the irradiation of the visible light frontward, the address electrodes 11 may be formed of a non-transparent material, i.e., a metal having superior conductivity.

The barrier ribs 16 are provided on the dielectric layer 13 of the rear substrate to actually divide the discharge cells 17. The barrier ribs 16 include first barrier rib members 16*a* extending along the y-axis and second barrier rib members 16*b* extending along the x-axis between the first barrier rib members 16*a*. The first and second barrier rib members 16*a* and 16*b* form the discharge cells 17 in a matrix structure.

Alternatively, the barrier ribs 16 may include first barrier rib members extending along the y-axis and spaced apart from each other along the x-axis. The first barrier rib members thus form the discharge cells in a stripe structure. This structure is not shown in the drawings. That is, the discharge cells have a structure that is open along the y-axis.

In this embodiment, the barrier ribs 16 define the discharge cells 17 in the matrix structure. From this matrix structure, when the second barrier rib members 16*b* are removed, discharge cells formed in the stripe structure by the first barrier rib members 16*a* can be formed. Therefore, a drawing illustrating the discharge cells formed in the stripe structure has been omitted herein.

The phosphor layer 19 in each discharge cell 17 is formed by printing or depositing fluorescent paste on sidewalls of the barrier ribs 16 and a surface of the dielectric layer 13 disposed between the barrier rib members 16*a* and 16*b* through a printing or dispensing process, and drying and firing the printed or deposited fluorescent paste.

The phosphor layers 19 formed in the discharge cells 17 arranged along the y-axis are formed of phosphors of an identical color. In addition, the phosphor layers 19 formed in the discharge cells 17 arranged along the x-axis are formed of alternately red, green, and blue phosphors R, G, and B.

Figure 3:
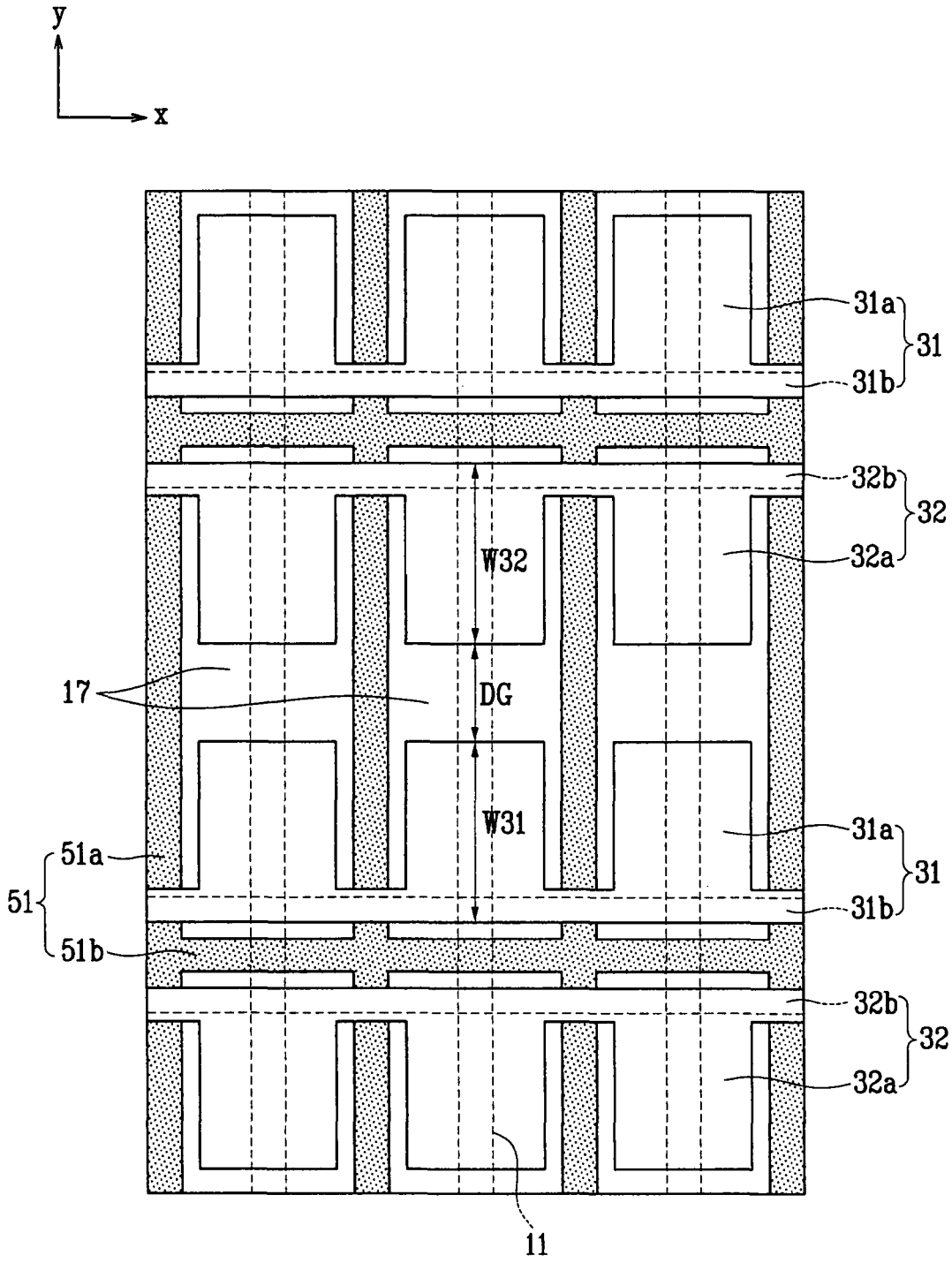
FIG. 3 is a top view of an arrangement of a color pattern and electrodes according to an embodiment of the present invention.

Referring to FIG. 3, the sustain and scan electrodes 31 and 32 are provided on an inner surface of the front substrate 20 to form surface discharge structures that can induce the gas discharge in the discharge cells 17. The sustain and scan electrodes 31 and 32 are formed to extend along the x-axis crossing the address electrodes 11.

Alternatively, the sustain and scan electrodes may be provided between the front and rear substrates to form an opposed discharge structure corresponding to the discharge cells. This is not shown in the drawing.

Each of the sustain and scan electrodes 31 and 32 includes a transparent electrode 31*a* and 32*a*, and a bus electrode 31*b* and 32*b* for supplying a voltage signal to the transparent electrode 31*a* and 32*a*. The transparent electrodes 31*a* and 32*a* are provided to induce a surface discharge in the discharge cells 17. In order to obtain a sufficient aperture ratio of the discharge cells 17, the transparent electrodes 31*a* and 32*a* are formed of a transparent material such as Indium Tin Oxide (ITO). The bus electrodes 31*b* and 32*b* are formed of a metal material having a superior conductivity to compensate for a high resistivity of the transparent electrodes 31*a* and 32*a*.

The transparent electrodes 31*a* and 32*a* mutually form the surface discharge structure by being arranged along the y-axis and having respectively widths W31 and W32 in a direction from an outer portion to a central portion of each discharge cell 17. A discharge gap DG is formed between the transparent electrodes 31*a* and 32*a* at the central portion of each discharge cell 17. The bus electrodes 31*b* and 32*b* are arranged on the transparent electrodes 31*a* and 32*a* and extend along the x-axis at the outer portions of the discharge cells 17. Therefore, when a voltage signal is supplied to the bus electrodes 31*b* and 32*b*, the voltage signal is transmitted to the transparent electrodes 31*a* and 32*a* connected to the bus electrodes 31*b* and 32*b*.

Referring again to FIGS. 1 and 2, the sustain and scan electrodes 31 and 32 cross the address electrodes 11. The sustain and scan electrodes 31 and 32 are covered by a dielectric layer 40 while facing each other in the discharge cells 17. The dielectric layer 40 protects the sustain and scan electrodes 31 and 32 from the gas discharge, and generates and accumulates wall charges during the discharge.

The dielectric layer 40 is covered by a protective layer 23. For instance, the protective layer 23 is formed of transparent MgO to protect the dielectric layer 40 and increase a second electron emission coefficient during the discharge.

When the PDP is driven, a reset discharge occurs due to a reset pulse supplied to the scan electrodes 32 during a reset period and an address discharge occurs due to a scan pulse supplied to the scan electrodes 32 and an address pulse supplied to the address electrodes 11 during an address period following the reset period. Then, a sustain discharge occurs due to the sustain pulse supplied to the sustain and scan electrodes 31 and 32 during a sustain period.

The sustain and scan electrodes 31 and 32 function as electrodes for supplying the sustain pulse required for the sustain discharge. The scan electrodes 32 function as electrodes for supplying the reset and scan pulses. The address electrodes 11 function as electrodes for supplying the address pulse. The sustain, scan, and address electrodes 31, 32, and 11 may vary their functions depending on voltage waveforms respectively supplied thereto. Therefore, the functions thereof are not limited to the arrangement described above.

The PDP selects discharge cells 17 that will be turned on by the address discharge occurring due to the interaction between the address and scan electrodes 11 and 32 and drives the selected discharge cells 17 using the sustain discharge occurring due to the interaction between the sustain and scan electrodes 31 and 32, thereby displaying an image.

In order to enhance the bright room contrast by increasing the black color ratio using a subtractive color effect without deteriorating the luminance and light emission efficiency, the PDP of the present embodiment includes first and second colored layers 51 and 52.

The first and second colored layers 51 and 52 are formed with different colors that can make black through the subtractive color effect. For example, the first color layer 51 is brown and the second color layer 52 is blue.

The first colored layer 51 is formed on portions of the barrier ribs 16 that are close to the sustain and scan electrodes 31 and 32. For example, the first colored layer 51 is formed in a pattern identical to that of the barrier ribs 16 so as to correspond to the shape of the barrier ribs 16 (see FIG. 3). The first colored layer 51 is formed by pattern-printing colored barrier rib paste on a top surface of the barrier ribs 16. The first colored layer 51 may be formed of a material identical to or different from that of the barrier ribs 16.

For instance, the first colored layer 51 includes first colored portions 51*a* corresponding to the first barrier rib members 16*a* and second colored portions 51*b* corresponding to the second barrier rib members 16*b*.

That is, the first colored portions 51*a* extend along the y-axis on the first barrier rib members 16*a*, and the second colored portions 51*b* extend along the x-axis between the first colored portions 51*a* on the second barrier rib members 16*b*.

As described above, the first colored layer 51 may be effectively formed on the barrier ribs 16 through pattern-printing. Since the barrier ribs 16 are an inactive region where no visible light is generated, the first colored layer 51 formed on the barrier ribs 16 is brown but does not intercept the visible light. Therefore, the absorption of the visible light generated in the discharge cells 17 is minimized.

The dielectric layer 40 formed on the front substrate 20 includes a first dielectric layer 41 covering the sustain and scan electrodes 31 and 32 and a second dielectric layer 42 formed on the first dielectric layer 41. Needless to say, the dielectric layer 40 may further include additional layers in addition to the first and second dielectric layers 41 and 42.

For example, the second colored layer 52 may be formed together with the second dielectric layer 42 on the first dielectric layer 41. In addition, the second colored layer 52 is formed in a pattern identical to that of the barrier ribs 16. That is, the second colored layer 52 is formed in a pattern the same as that of the first colored layer 51. The second colored layer 52 is formed by pattern-printing colored dielectric paste on the first dielectric layer 41.

That is, the second colored layer 52 includes third colored portions 52*a* formed on the first dielectric layer 41 and corresponding to the first colored portions 51*a*, and fourth colored portions 52*b* corresponding to the second colored portions 51*b*. Therefore, the third colored portions 52*a* are formed to correspond to the first barrier rib members 16*a* and the fourth colored portions 52*b* are formed to correspond to the second barrier rib members 16*b*.

The second dielectric layer 42 and the first colored layer 51 are formed with an identical thickness on the first dielectric layer 41. The visible light is intercepted by the first colored layer 51 and emitted frontward through the first dielectric layer 42. That is, the first and second dielectric layers 41 and 42 are formed of a transparent dielectric. The second dielectric layer 42 is formed in portions divided by the third and fourth colored portions 52*a* and 52*b*. That is, the second dielectric layer 42 has a pattern corresponding to the discharge cells 17.

Accordingly, the first colored layer 51 is formed on the barrier ribs 16 to correspond to the barrier ribs 16 that are the inactive region, and the second colored layer 52 is formed on the first dielectric layer 41 of the front substrate 20 to correspond to the first colored layer 51.

As a result, the first and second colored layers 51 and 52 generate a black region at the inactive region corresponding to the barrier ribs 16 by the subtractive color effect, thereby improving the bright room contrast while maintaining a high luminance and light emission efficiency by absorbing external light without interrupting the visible light generated in the discharge cells 17.

The protective layer 23 is formed on the second dielectric layer 41 and the second colored layer 52 to protect the second dielectric layer 41 and the second colored layer 52 from the discharge.

As described above, according to the PDP of an embodiment of the present invention, since the first colored layer is formed on the barrier ribs that are the inactive region and the second colored layer is formed on the dielectric layer to correspond to the first colored layer, the black region is formed by the subtractive color effect between the first and second colored layers, thereby improving the bright room contrast while maintaining a high luminance and light emission efficiency without interrupting the visible light generated in the discharge cells.

Although an embodiment of the present invention has been described in detail hereinabove, it should be clearly understood that many variations and/or modifications of the basic inventive concept taught herein still fall within the spirit and scope of the present invention, as defined by the appended claims.

What is claimed is:

1. A Plasma Display Panel (PDP) comprising:

first and second substrates facing each other and spaced apart from each other;

barrier ribs arranged between the first and second substrates and defining discharge cells;

an address electrode extending in a first direction to correspond to the discharge cells;

first and second electrodes arranged on one of the first and second substrates and extending in a second direction crossing the first direction to correspond to the discharge cells;

a first dielectric layer covering the first and second electrodes;

a first colored layer arranged on a portion of the barrier ribs close to the first and second electrodes;

a second colored layer arranged on the first dielectric layer and corresponding to the first colored layer, the first and second colored layers inducing a subtractive color effect; and a second dielectric layer arranged on a portion of the first dielectric layer on which the second colored layer is not arranged.

2. The PDP of claim 1, wherein the first colored layer is brown.

3. The PDP of claim 2, wherein the second colored layer is blue.

4. The PDP of claim 3, wherein the first colored layer has a pattern identical to that of the barrier ribs.

5. The PDP of claim 3, wherein the second colored layer faces a pattern of the barrier ribs.

6. The PDP of claim 3, wherein the barrier ribs comprise first barrier rib members extending in the first direction and spaced apart from each other in the second direction at a distance corresponding to the discharge cells.

7. The PDP of claim 6, wherein the barrier ribs comprise second barrier rib members extending in the second direction and spaced apart from each other in the first direction at a distance corresponding to the discharge cells.

8. The PDP of claim 7, wherein the first colored layer comprises:

first colored portions arranged on the first barrier rib members in the first direction; and second colored portions arranged on the second barrier rib members in the second direction.

9. The PDP of claim 8, wherein the second colored layer comprises:

third colored portions arranged on the first dielectric layer and corresponding to the first colored portions; and fourth colored portions arranged on the first dielectric layer while crossing the third colored portions and corresponding to the second colored portions.

10. The PDP of claim 9, wherein the second dielectric layer is arranged in portions divided by the third and fourth colored portions of the second colored layer.

11. The PDP of claim 1, wherein the second dielectric layer has a thickness identical to that of the second colored layer.

12. The PDP of claim 1, further comprising a protective layer covering the second dielectric layer and the second colored layer.

* * * * *